United States Patent [19]

Walsh

[11] 4,432,204

[45] Feb. 21, 1984

[54] LINEAR HYDRAULIC DRIVE SYSTEM FOR A STIRLING ENGINE

[75] Inventor: Michael M. Walsh, Schenectady, N.Y.

[73] Assignee: Mechanical Technology Incorporated, Latham, N.Y.

[21] Appl. No.: 384,303

[22] Filed: Jun. 2, 1982

[51] Int. Cl.[3] ..... F02G 1/04

[52] U.S. Cl. ..... 60/520; 60/517; 417/383; 417/397

[58] Field of Search ..... 60/517, 520, 593; 62/61; 417/379, 383, 389, 397, 384, 385, 386, 388; 92/48

[56] References Cited

U.S. PATENT DOCUMENTS 1,282,145 10/1918 Tobler ..... 417/383 X 3,604,821 9/1971 Martini ..... 417/379

4,380,152 4/1983 Folsom et al. ..... 60/520

*Primary Examiner*—Allen M. Ostrager

*Assistant Examiner*—Stephen F. Husar

*Attorney, Agent, or Firm*—Joseph V. Claeys; Arthur N. Trausch, III

[57] ABSTRACT

A hydraulic drive system operating from the periodic pressure wave produced by a Stirling engine along a first axis thereof and effecting transfer of power from the Stirling engine to a load apparatus therefor and wherein the movable, or working member of the load apparatus is reciprocatingly driven along an axis substantially at right angles to the first axis to achieve an arrangement of a Stirling engine and load apparatus assembly which is much shorter and the components of the load apparatus more readily accessible.

10 Claims, 2 Drawing Figures

LINEAR HYDRAULIC DRIVE SYSTEM FOR A STIRLING ENGINE

The Government of the United States of America has rights in this invention pursuant to a Subcontract under Contract No. 86X-61618C awarded by the U.S. Department of Energy.

TECHNICAL FIELD

This invention relates to a new and improved linear hydraulic drive system for use with a Stirling engine and arranged and constructed to operate from the periodic pressure wave of the Stirling engine to reciprocally drive the movable member of the load apparatus.

More particularly, the invention relates to such a linear hydraulic drive system wherein the hydraulic fluid is sealed between a pair of spaced-apart flexible diaphragms. The load apparatus to be driven is disposed within the space between the diaphragms. One of the diaphragms is arranged to be acted on by the periodic pressure wave of the Stirling engine and functions as a power coupling diaphragm and the other diaphagram is acted on by the resulting pressure wave produced in the hydraulic fluid and is arranged as part of a gas spring means.

While the new and improved hydraulic drive system of this invention is capable of use in a variety of applications it is particularly advantageous and especially suited for use with a Stirling engine to transfer power from the periodic pressure wave produced by such Stirling engine and will be particularly described in that connection. Also, while the invention will be generally described in connection with a compressor as a specific load apparatus, it is to be understood that the invention is not limited to compressors and the load apparatus to be driven may be a pump, a linear alternator, or other like load apparatus.

BACKGROUND PRIOR ART

Resonant free piston Stirling engine systems are known in the art wherein the load apparatus is hydraulically driven from the periodic pressure wave of the engine, in such known systems the load apparatus is disposed within an incompressible fluid-filled space between a pair of flexible diaphragms which seal in and isolate the incompressible fluid, referred to hereafter as "hydraulic oil," from the Stirling engine. One of the diaphragms is arranged to be exposed to and acted on by the periodic pressure wave of the engine and the other diaphragm, acted on by the resulting pressure wave produced in the hydraulic oil, is arranged as part of a gas spring means. The pressure waves produced in the hydraulic oil are operative to reciprocally drive the movable member of the load apparatus in a direction along the same axis as that of the Stirling engine.

Such prior art engine-drive system assemblies were arranged in a stacked, coaxial relationship. While generally satisfactory from an operating standpoint, such prior art arrangements have typically been very long, causing mounting problems and preventing installation in conventional sized housing cabinets. In addition, in such prior arrangements all components of the load apparatus are disposed internally in the sealed oil-filled drive system making assembly of the load apparatus, as well as, maintenance, service, and repair both difficult and expensive. The present invention overcomes one or more of these prior art problems while also providing a more compact Stirling engine-load apparatus assembly.

SUMMARY OF THE INVENTION

It is a primary object of the invention to provide a new and improved linear hydraulic drive system for use with a Stirling engine which reduces substantially the length of the engine-drive assembly.

It is another object of the invention to provide a linear hydraulic drive system for use with a Stirling engine wherein the hydraulic oil is positively isolated from the Stirling engine and which is compact, lightweight, readily assembled with fewer components than prior art arrangements and can be mounted in operating relationship with such engine so as to provide easy access to various components of the load apparatus for easier assembly, repair and servicing.

I have discovered that the pressure waves produced in the hydraulic oil within a flexible diaphragm-sealed housing can be simply and effectively "bent" whereby a periodic pressure wave initially directed along a first axis is made to produce reciprocating movement of a drive member (piston) along an axis substantially at right angles to the first axis.

Briefly stated, in accordance with one aspect of the invention the new and improved linear hydraulic drive system comprises a housing sealed at its opposite ends by first and second flexible diaphragms and filled with an incompressible fluid (oil). One of the diaphragms is disposed adjacent the Stirling engine to be exposed to and acted on by the periodic pressure wave produced by the engine, and the other diaphragm is arranged as part of a gas spring means. A drive member is arranged for sealed, reciprocal movement within a central bore extending transversely within the oil-filled housing. Movement of the diaphragms as a result of the action of the periodic pressure wave of the engine causes reciprocating movement of the drive member along an axis which is substantially at right angles to the direction of movement of the diaphragms. The hydraulic drive system of the invention, therefore, translates the movement of the diaphragms along one axis to drive movement which is substantially at right angles to such diaphragm movement.

A system incorporating features of the present invention is described and claimed in copending application Ser. No. 384,304 filed June 2, 1982.

BRIEF DESCRIPTION OF THE DRAWINGS

These and other objects, features, and many of the attendant advantages of this invention will become better understood upon a detailed reading of the following description considered in conjunction with the accompanying drawing wherein FIG. 1 (A and B) is a longitudinal sectional view of a Stirling engine coupled with the new and improved hydraulic drive system in accordance with one embodiment of the invention.

BEST MODE OF PRACTICING THE INVENTION

Figure 1A:
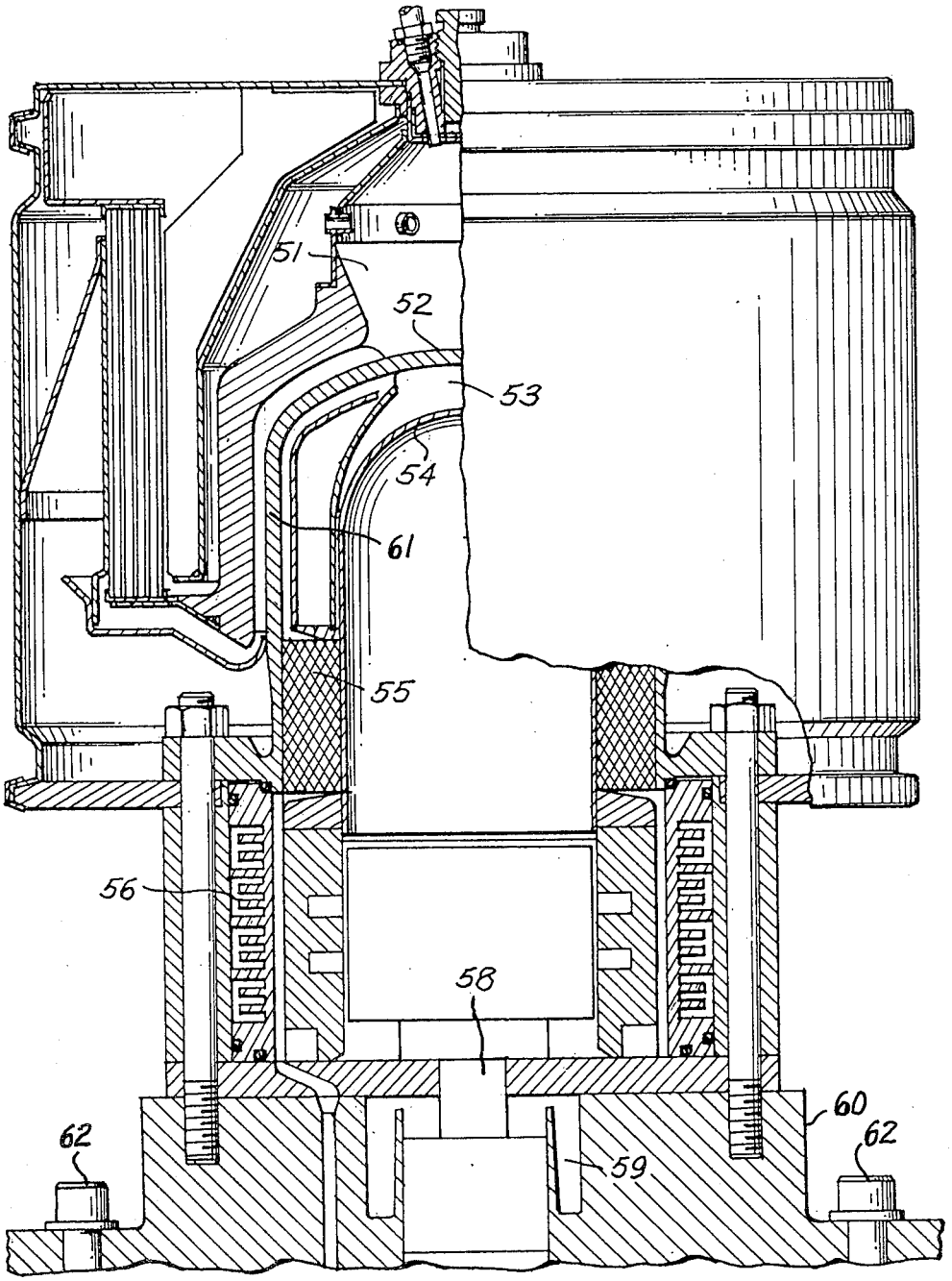

FIG. 1 (A and B) illustrates the overall assembly of a resonant free piston Stirling engine (RFPSE) in combination with the hydraulic drive system in accordance with one embodiment of the present invention. The engine illustrated includes a combustor 51 for heating a working fluid contained within a suitable vessel 52. Vessel 52 defines an expansion space 53 within which a displacer 54 reciprocates along the longitudinal axis.

The expansion space 53 communicates through suitable fluid passageways 61 via a regenerator 55 and cooler 56 with a compression space 57 at the opposite end of the Stirling engine housing from the expansion space 53. The displacer 54 is connected to and drives a displacer rod 58 having skirts attached thereto which define gas spring volumes such as 59 which help to spring the displacer 54 within the space defined by the heating vessel 52 between compression 57 and expansion space 53.

For a more detailed description of the construction and operation of the Stirling engine, reference is made to U.S. patent application Ser. No. 172,373, filed July 25, 1980, now U.S. Pat. No. 4,380,152—John J. Dineen, et al.—Inventors, entitled, "Diaphragm Displacer Stirling Engine Powered Alternator—Compressor," assigned to Mechanical Technology Incorporated, the assignee of the present invention. However, for the purpose of this disclosure, it can be stated briefly that the combustor 51 heats the working gas which is trapped within the expansion space 53 between displacer 54 and vessel 52. Hot gases from combustor 51 flow around the exterior of the heating vessel 52 and then are exhausted out through suitable exhaust ports (not shown) continuously during operation of the engine. The hot combustion gases thus supplied cause the working gas in expansion space 53 to be heated and expanded. The heat is added continually to the working gas through heat exchanger passages on vessel 52. As the gas is heated it causes a small increase in the internal engine pressure. This pressure increase causes both distension of the diaphragm 66 and a downward force on the displacer 54 due to an imbalance between the areas exposed to the expansion space 53 and the compression space 57. The force on the displacer 54 causes downward motion which moves the compressed cold gas from the compression space 57 through the connecting passages and elements into the expansion space 53 further increasing pressure. When most of the gas is in the expansion space and maximum expansion has occurred the pressure drops slightly. The energy stored in the displacer spring 59 causes it to move upwardly, shuttling gas from the expansion space through the regenerator and cooler to the compression space. As the gas is cooled pressure drops further causing the displacer to move further into the expansion space until nearly all the gas has been moved into the compression space. There energy stored in the compressor spring 72 recompresses the gas and the cycle beings anew.

Figure 1B:
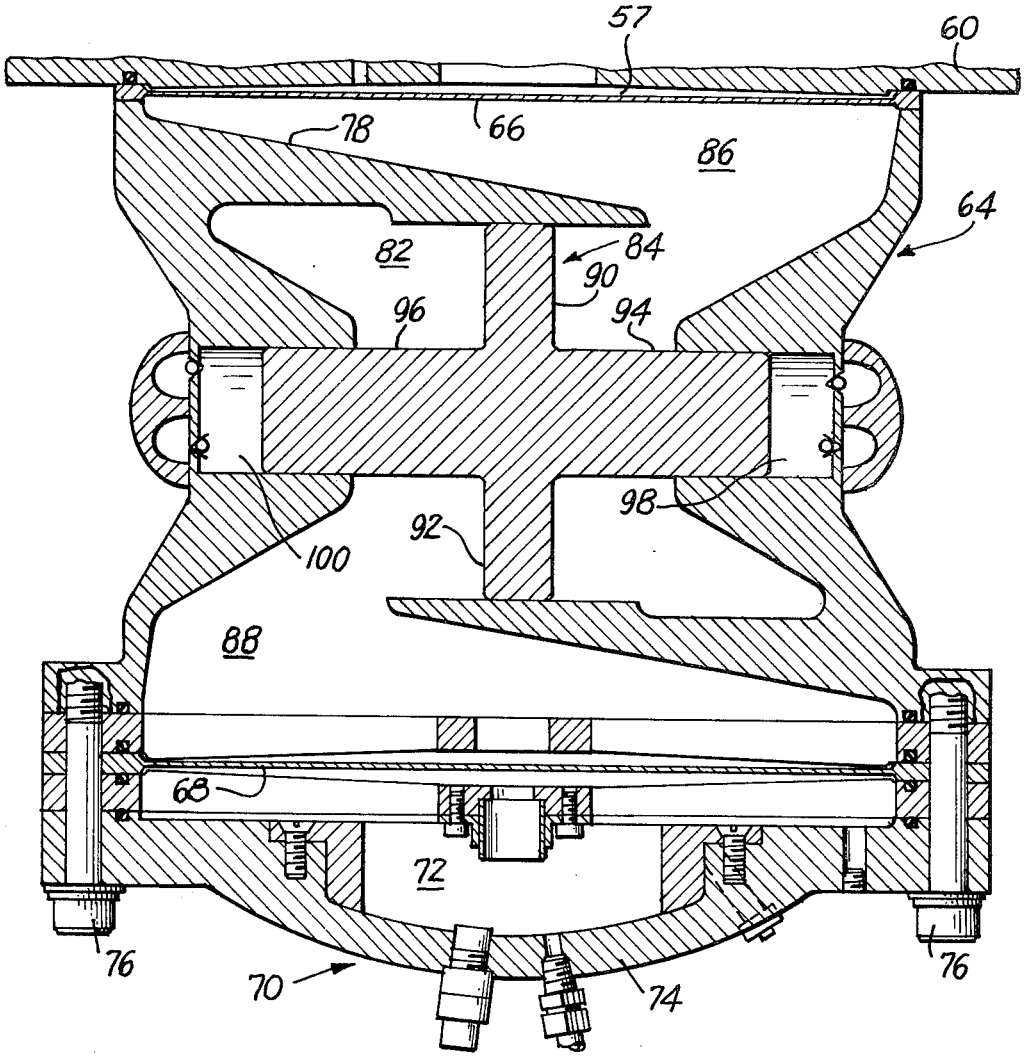

As shown in FIG. 1B, the hydraulic drive system is comprised by a housing 64 having a first end closed by a flexible diaphragm 66. In the arrangement illustrated, such flexible diaphragm is also the power coupling flexible diaphragm and working member of the RFPSE. Housing 64 has a second open end which is closed by a second flexible diaphragm 68 which is disposed directly opposite the first flexible diaphragm 66 and which comprises part of a gas spring means designated generally at 70. Gas spring means 70 includes a bounce space 72 which is defined between the flexible diaphragm 68 and the end cap 74 which is secured by bolts 76 to the housing 64. The housing 64 may be of any suitable material, including cast iron, steel, aluminum, or other like material and is filled with an incompressible fluid, such as a suitable hydraulic oil.

The previously mentioned pressure wave in the hydraulic oil acts on the flexible diaphram 68 causing it to also be deflected downwardly and compressing the gas within the space 72 of gas spring means 70.

The periodic heating and cooling of the working gas in the working spaces of the Stirling engine as briefly described above produces a periodic pressure wave in the compression space 57 which acts upon the flexible diaphragm 66 in the above-described manner to cause it to flex downwardly periodically and to produce a resulting periodic pressure wave in the hydraulic oil within the housing 64.

Referring again to FIG. 1B, membrance 78 extends diagonally from the upper portion of one side wall of the housing 64 and to the lower portion of the opposite sidewall of housing 64. Piercing the membrane 78 is a central bore 82 extending transversely within the housing 64 substantially at right angles to the longitudinal axis of the RFPSE and the axial direction of movement of the flexible diaphragms 66 and 68 during flexure.

A driving member, shown as piston 84, is disposed within the bore 82 for sealed, reciprocating movement therein. The arrangement of the membrane 78 in conjunction with the piston 84 divides the internal volume of the housing 64 into two effectively separate spaces of cavities 86 and 88. The first cavity 86 communicates with the power coupling flexible diaphragm 66 and the surface area 90 of the piston 84, while the second cavity 88 communicates with the gas spring flexible diaphragm 68 and the opposite surface area 92 of the piston 84.

The piston 84 comprises the drive member of the hydraulic drive system and can be arranged in various ways to drive the load apparatus of the RFPSE. The piston may be arranged to directly or indirectly drive the pistons of a gas compressor or pump or may itself be the driven load member, such as where the piston itself may be arranged to be integrally incorporated with the load apparatus, it may, for example, be incorporated into the armature or plunger of a linear alternator or the pistons of a compressor or pump. Thus, as shown in FIG. 1B the piston 84 has smaller pistons 94 and 96 formed at opposite ends thereof which are disposed in sealed, reciprocal relationship with suitable valved compressor cylinders 98 and 100 to provide a double-acting gas compressor driven by the reciprocating piston 84.

In operation, the resonant free piston Stirling engine (RFPSE) mounted above the first flexible diaphragm 66 will operate in the normal manner to produce a periodic pressure wave that acts on diaphragm 66 to cause it to flex downwardly. Downward flexing of diaphragm 66 produces a pressure wave in the incompressible fluid (hydraulic oil) in cavity 86 causing piston 84 to be moved to the left from the position shown. This in turn produces a pressure wave in the oil in cavity 88 and causes the gas spring flexible diaphragm 68 to flex downwardly in the same axial direction of movement as the flexure of the power coupling first diaphragm 66. It will be noted, however, that movement of the piston 84 is substantially at right angles to the axial direction of movement of the first and second flexible diaphragms 66 and 68. As the periodic pressure wave cyclically reduces in pressure in the normal manner of a Stirling engine, the compressed gas in the gas spring volume enclosed below the second flexible diaphragm 68 causes diaphragm 68 to be returned through spring action toward its mid-center position. This action in turn produces a pressure wave in the oil in cavity 88 causing piston 84 to be moved toward the right. This movement of the piston 84 in turn produces a pressure wave in the oil in cavity 86 causing power coupling diaphragm 66 to be moved back toward its midcenter position in conjunction with the normal spring action built into the power coupling first flexible diaphragm 66. The result of this repeated sequence of actions is a reciprocating movement of the piston 84 within central bore 82 substantially at the same frequency as the frequency of the periodic pressure wave produced by the RFPSE and substantially at right angles to the direction of such periodic pressure wave. The gas compressor pistons operate in the conventional manner alternately compressing, expelling and ingesting gas in the compression spaces of their respective valved cylinders 98 and 100.

From the above brief description of FIG. 1, it will be appreciated that the invention provides an arrangement whereby there is a folding or "bending" of the incompressible hydraulic oil-flow path resulting in an effective rotating of the drive axis of the load apparatus substantially 90° with respect to the RFPSE axis. The hydraulic oil acts on either side of the transverse piston to produce reciprocating movement thereof. The effect achieved is to greatly reduce the length of the overall RFPSE and load apparatus assembly, and does so without any increase in overall width (which is controlled by the power coupling flexible diaphragm diameter). In addition, the location of the compressor heads including the inlet and discharge plenums, valves and compressor pistons and cylinders are now in a readily accessible exterior location where they can be serviced and changed if necessary without having to disassemble or otherwise affect the hydraulic drive subsystem. This makes initial fabrication and assembly as well as subsequent servicing much less complex, and cheaper than otherwise possible with prior known arrangements.

While only a preferred embodiment of the invention and the best mode contemplated for carrying it out have been shown and described by way of illustration, many changes and modifications will occur to those skilled in the art. It is, therefore, to be understood that the appended claims are intended to cover all such changes and modifications as fall within the true spirit and scope of the invention.

Industrial Application

The invention relates to Stirling heat engines and to an improved hydraulic drive system therefore and providing systems such as electrical power generators, compressors, pumps, and other like apparatus and systems having a wide variety of applications, residential, commercial and industrial.

What is claimed is:

1. A hydraulic drive system for transferring power from a periodic pressure wave directed along a first axis to the movable member of a load means, comprising:

a housing filled with an incompressible fluid and sealed at its opposite ends by first and second flexible diaphragms, said first diaphragm being arranged to be exposed to the periodic pressure wave and said second diaphragm being arranged as part of a gas spring means; and means within said housing for directing the pressure wave produced in said incompressible fluid by action of said periodic pressure wave along an axis which is substantially at right angles to said first axis, said means including a cylinder which is transverse to said first axis and a drive member disposed within said cylinder for sealed, reciprocating movement therein.

2. The hydraulic drive system recited in claim 1 wherein said means for directing said periodic pressure wave comprises means dividing the space within said housing into separate volumes, one of which volumes is arranged to be in communication with said first diaphragm and the other of which volumes is arranged to be in communication with said second diaphragm.

3. The hydraulic drive system recited in claim 1 wherein said transverse cylinder and said drive member disposed therein are operative to divide the space within said housing into separate volumes, one of which is in communication with the first diaphragm and one surface of said drive member and the other of which is in communication with the opposite surface of said drive member and said second diaphragm.

4. The hydraulic drive system recited in claims 1, 2, or 3 wherein said load apparatus is a double-acting compressor means having compressor cylinders disposed at opposite sides of said housing and said drive member is arranged to impart its reciprocating movement to the working members of said compressor means.

5. The hydraulic drive system recited in claim 1 wherein said transverse cylinder is formed by a membrane extending diagonally from the upper portion of one side wall of said housing to the lower portion of the opposite side wall of said housing.

6. The hydraulic drive system recited in claim 1 wherein said drive member includes an enlarged central portion which is disposed within said cylinder for sealed, reciprocating movement therein and having smaller diameter portions extending in opposite directions from said central portion to define pistons; and valved compressor cylinders one formed in each of the side walls of said housing arranged to receive said pistons for sealed, reciprocating movement therein to provide a double-acting compressor means.

7. In combination, a Stirling engine operative to produce a periodic pressure wave directed along a first axis through a compression space closed at one end by a first flexible diaphragm;

a housing adapted to be filled with an incompressible fluid having first and second oppositely disposed open ends;

means coupling said housing to said Stirling engine so that said first open end of said housing is closed by said first flexible diaphragm;

a second flexible diaphragm secured to said housing and closing said second open end thereof;

closure means secured to said housing and defining a gas spring means with said second flexible diaphragm;

a cylinder formed within said housing in the space between said first and second flexible diaphragms, said cylinder being transverse to said first axis;

a drive member disposed within said cylinder for sealed, reciprocating movement therein, said cylinder and drive member being arranged within said housing to divide the space therein into separate volumes, one of which is in communication with said first flexible diaphragm and one surface of said drive member and the other of which is in communication with the opposite surface of said drive member and said second flexible diaphragm.

8. A combination heat-driven resonant free piston Stirling engine and a hydraulically-driven load apparatus, comprising:

a Stirling engine housing having a combustor for heating a working fluid within an expansion chamber, a displacer reciprocally movable within the expansion chamber, a regenerator, a cooler, a compression space and fluid passageways interconnecting the expansion chamber with the compression space via the regenerator and cooler, said displacer serving to shuttle the working fluid back and forth between the expansion chamber and the compression space via the regenerator and cooler to develop a periodic pressure wave within the compression space;

a power coupling first flexible diaphragm closing the compression space a housing adapted to be filled with an incompressible fluid having a first side closed by said first flexible diaphragm which is exposed to said periodic pressure wave and a second side opposite the first side closed by a second flexible diaphragm that comprises part of a gas spring means, said housing having a bore extending therein which is transverse to the axial direction of movement of the first and second flexible diaphragms and forming a cylinder within the housing; a reciprocally movable piston disposed in said cylinder, said piston moving along an axis that is substantially at a right angle relative to the direction of axis movement of the power coupling and second flexible diaphragms.

9. The hydraulic drive system recited in claim 8 wherein said transverse cylinder is formed by a membrane extending from the upper portion of one side wall of said housing to the lower portion of the opposite side wall of said housing.

10. The hydraulic drive system recited in claim 8 wherein said drive member includes an enlarged central portion which is disposed within said cylinder for sealed, reciprocating movement therein and having smaller diameter portions extending in opposite directions from said central portion to define pistons, and valved compressor cylinders one formed in each of the side walls of said housing arranged to receive said pistons for sealed, reciprocating movement therein to provide a double-acting compressor means.

* * * * *